US005086257A

United States Patent [19]

Gay et al.

[11] Patent Number: 5,086,257

[45] Date of Patent: Feb. 4, 1992

[54] PLASMA PANEL WITH INCREASED ADDRESSABILITY

[75] Inventors: Michel Gay, Le Fontanil; Jacques Deschamps, Grenoble; Serge Salavin, St. Egreve, all of France

[73] Assignee: Thomson-CSF, Puteaux, France

[21] Appl. No.: 399,082

[22] Filed: Aug. 28, 1989

[30] Foreign Application Priority Data

Aug. 30, 1988 [FR] France ..... 8811355

[51] Int. Cl.[5] ..... G09G 3/10

[52] U.S. Cl. ..... 315/169.4; 315/169.1; 340/775; 340/776

[58] Field of Search ..... 315/169.4, 169.1; 313/581, 582, 584, 586; 340/781, 752, 779, 771, 775, 776

[56] References Cited

U.S. PATENT DOCUMENTS

| | | | |
|---|---|---|---|
| 3,704,389 | 11/1972 | McClelland | 315/169.4 X |
| 4,164,678 | 8/1979 | Biazzo et al. | 313/582 X |
| 4,737,686 | 4/1988 | Harrey | 315/169.4 X |
| 4,924,218 | 5/1990 | Weber et al. | 315/169.4 X |

OTHER PUBLICATIONS

Proceedings of the SID, vol. 27, No. 3, 1986, pp. 183-187, Los Angeles, U.S.; G. W. Dick: "Three-electrode-per-pel AC plasma display panel".

IBM Technical Disclosure Bulletin, vol. 23, No. 10, Mar. 1981, pp. 4536-4537, New York, U.S.; M. O. Aboelfotoh: "Structure to reduce glow spreading in DC panel".

*Primary Examiner*—Eugene R. Laroche
*Assistant Examiner*—Ali Neyzari
*Attorney, Agent, or Firm*—Oblon, Spivak, McClelland, Maier & Neustadt

[57] ABSTRACT

Disclosed is a plasma panel wherein the row electrodes and/or column electrodes are arranged to enable, notably, a selective type of addressing of several rows of pixels simultaneously. This is obtained, firstly, by a demultiplication of the row electrodes and by an increase in the number of column electrodes, the result thereof being a greater number of crossings between column and row electrodes and, secondly, by an increase in the surface of the crossings designed to form pixels, and by a limiting of the voltages applied to the electrodes.

21 Claims, 5 Drawing Sheets

PLASMA PANEL WITH INCREASED ADDRESSABILITY

BACKGROUND OF THE INVENTION

1. Field of the Invention

The present invention concerns a plasma panel with its electrodes arranged in a novel way so as to make it possible, notably, to increase the speed of obtaining the images displayed by this panel.

2. Description of the Prior Art

Plasma panels are flat panel or flat screen display devices that are now well known. They enable the display of alphanumerical, graphic or other images, in color or otherwise. Generally, plasma panels comprise two insulating plates bounding a volume occupied by a gas (generally a neon-based mixture). These plates support conductive electrodes, placed in columns and called column electrodes, and electrodes placed in rows, called row electrodes. These column and row electrodes intersect or cross one another so as to define a matrix of cells each forming a picture element or pixel. The working principle is the selective generation, at the crossing of row electrodes and column electrodes, namely at selected pixels, of electrical discharges in the gas. Data is displayed through an emission of light which accompanies theses discharges.

Certain plasma panels work in DC mode, but it is most commonly preferred to use so-called "AC" type panels, the working of which is based on an excitation of the electrodes in AC mode. In this case, the electrodes are coated with a layer of dielectric material and are no longer in direct contact either with the gas or with the discharge. One of the advantages of this type of plasma panel, called an "AC" plasma panel, is that it has a memory effect, enabling the useful information to be presented solely to the pixels for which it is desired to change the state (lit up or extinguished). At the other picture elements or pixels, the state of these pixels is simply sustained by repetition of alternating electrical discharges, called sustaining discharges, obtained solely for the pixels that are in the lit up state, i.e. written.

Under these conditions, the control of the pixels may consist in a point-by-point, i.e. pixel-by-pixel addressing operation, so that the duration of the addressing time, which limits the data refreshing rate, is not generally a problem.

It has to be noted that certain so-called AC type plasma panels use only two electrodes to define a pixel: one column electrode intersected with a row electrode. The working of a plasma panel of this type is known, notably from a French patent No. 78 04 893, filed on behalf of THOMSON-CSF and published under No. 2 417 848. This method also describes a method for the control of a panel such as this.

There are also known plasma panels, called "coplanar sustaining plasma panels", in which three or more electrodes are used to define a pixel. In this case, most often, each pixel of the matrix is formed by three electrodes, more precisely at the intersection between a column electrode and two parallel sustaining electrodes forming a pair of sustaining electrodes. With this type of screen, it is known that the sustaining of the discharges, namely the repetition of the above-mentioned alternating electrical discharges, is done between the two sustaining electrodes of one and the same pair, and that the addressing is done by the generation of discharges between two intersecting electrodes. In this case, the column electrode has a solely addressing function, and among the two electrodes of one and the same pair of electrodes, one electrode has a solely sustaining function while the other electrode fulfils a sustaining function and an addressing function.

A plasma panel of the AC coplanar sustaining type, with three electrodes per pixel, is known notably from the European patent document EP-A-0 135 382, which also describes a method for the control of this panel. At each pixel, the sustaining electrodes may have a protuberance or projecting surface: in one and the same pair of sustaining electrodes, the projecting surfaces of an electrode are pointed towards those of the other electrode, and the sustaining discharges occur between these projecting surfaces.

Another structure of the coplanar sustaining AC type is described, with its control system, in an article by G.W. DICK in PROCEEDINGS OF THE SID, vol 27/3, 1986, pages 183–187. It must be noted that, in the structure described in this document, the sustaining electrodes have a constant width, that is, they have no facing, projecting surfaces in a pair of sustaining electrodes, to define the sustaining discharge zone. By contrast, they have barriers made of an insulating material. These barriers serve to confine sustaining discharges in the zone of intersection with the column electrode.

In all these types of plasma panel, the column electrodes are individualized so that it is possible to select only one of them, i.e. they are each connected to a particular output of a control and addressing device. This is also so for the row electrodes in the case where a pixel is defined at the intersection of a column electrode and a single row electrode (for DC as well as AC type plasma panels). As regards the coplanar sustaining plasma panels, those of the sustaining electrodes that fulfil the function of sustaining the discharges and the addressing function (addressing-sustaining electrodes) are also all individualized.

Irrespectively of the type of plasma panel, the data refreshing rate is not generally a problem when the control method used is of the point-by-point addressing type. However, there are applications where it is desired to have the ability for addressing as rapidly as possible. These are, in particular, plasma panels which are required to have compatibility with standard video signals and for which, in particular, it is desired to achieve an intermediate level of luminance ("grey shades" or "half shades").

The time needed to form an image depends on the number of pixels and on the overall time needed for the addressing operations (erasure addressing and/or writing addressing operations) and sustaining operations.

To reduce the time needed to form an image, it is sought to reduce the overall addressing time. To this effect, the known method consists in controlling the pixels by a semi-selective type of addressing (which is generally a command either for the erasure or for the writing of all the pixels of a given row), followed by a selective type of addressing (wherein one or more selected pixels of this row are controlled so as to be carried to the state which is contrary to the state to which they have been taken by the semi-selective addressing). These two addressing phases form an addressing cycle and, at present, it appears to be difficult to reduce the duration of this addressing cycle to less than 20 microseconds.

Moreover, if it is desired to avoid a visually troublesome flicker, the renewal of the images in the case of dynamic images or with a gray tone should be done at least 50 times per second (frame time of less than 20 microseconds), so that it is difficult for the number of rows written per frame to exceed a thousand.

If the image is formed by only 512 rows, for example, and if the image is renewed 50 times per second, it is possible to obtain four gray tones, taking into account the method used to control these gray tones. Or again, with images of only 256 rows, these 256 rows may each be written four times per second. This leads to 14 levels of luminance or gray tones for each pixel, and an image limited to only 128 lines would enable 64 levels of luminance to be obtained whereas, all the same, it would be desirable to obtain, for example, 128 levels of luminance or gray tones for images of 512 rows.

The current state of the art does not enable sufficient increase in the row-by-row addressing speed, either with a view to obtaining a sufficient number of half-tones as explained above or, again, with a view to other results such as, for example, increasing the number of rows that form an image.

SUMMARY OF THE INVENTION

The present invention concerns a plasma panel, of both the DC and the AC type, with or without coplanar sustaining, the novel arrangement of which, particularly at the level of the electrodes, enables a considerable reduction, as compared with a prior art plasma panel, in the time needed for the addressing of all the rows forming an image, for the same number of pixels per row. This novel arrangement of electrodes enables, notably, the simultaneous addressing of several rows of pixels, both for the semi-selective addressing phase and for the selective addressing phase.

However, this is obtained at the cost of an increase in the number of electrodes, as compared with the number of electrodes needed in the prior art for a same number of pixels, the result of which is a difficulty, lying in the fact that the intersections between electrodes reach a number greater than the number of pixels desired.

The novel arrangement proposed by the present invention enables this difficulty to be surmounted in a simple way, and it is seen that the drawbacks given by this novel arrangement are more than compensated for by the advantages that it provides as regards the speed with which an image is obtained.

The invention proposes a plasma panel comprising pixels arranged in rows of pixels and columns of pixels, column electrodes crossing or intersecting with row electrodes, defining a plurality of crossings or intersections, each crossing having a crossing surface formed by the facing surfaces of the corresponding column electrode and row electrode wherein the crossings comprise, firstly, simple crossings, namely crossings not designed to form a pixel, and comprise, secondly, widened crossings having a greater crossing surface than the crossing surface of the simple crossings, and wherein each pixel is defined substantially at a widened crossing.

The authors of the invention have noted that the voltages needed between the electrodes to obtain the triggering and sustaining of the electrical discharges at the pixels depends on the crossing surfaces: smaller crossing surfaces require higher voltages and vice versa. So much so that the voltage applied between the electrodes may be enough to provoke electrical discharges at the crossings having a sufficient given crossing surface (a widened crossing where the pixels are formed), and this voltage may not be enough to provoke discharges at the other crossings with smaller surfaces.

BRIEF DESCRIPTION OF THE DRAWINGS

The invention will be better understood from the following description, given as a non-restrictive example and made with reference to the appended drawings, of which.

DETAILED DESCRIPTION OF THE INVENTION

Figure 1:
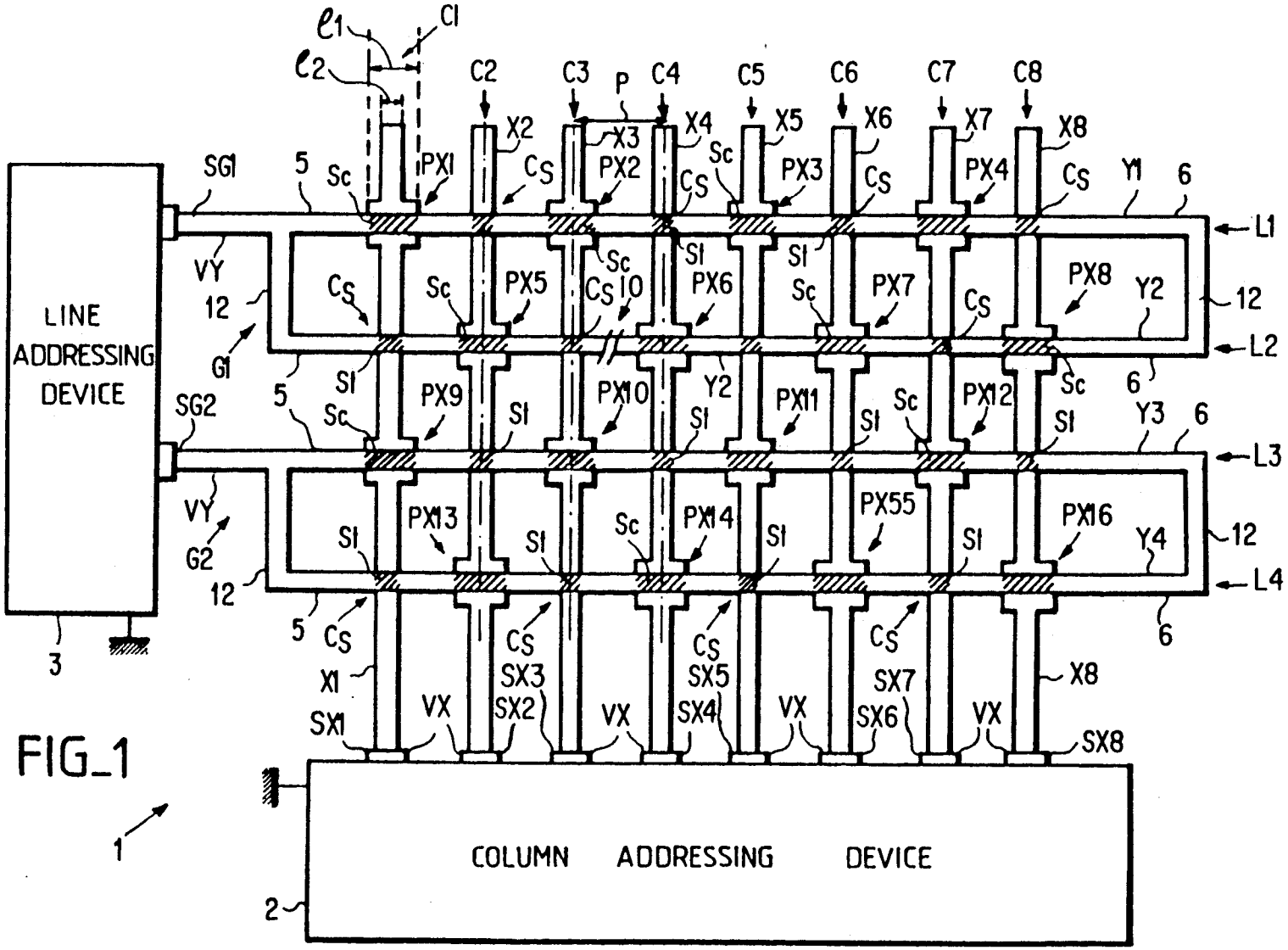
FIG. 1 gives a schematic view, as a non-restrictive example, of a plasma panel according to a first version of the invention, wherein column electrodes are rectilinear and enable the obtaining of pixels having a first type of distribution.

FIG. 1 shows a plasma panel which is represented chiefly by electrodes arranged in columns X1, X2, . . . , X8, called column electrodes, and row electrodes Y1 to Y4, perpendicular to the column electrodes X1 to X8. The column electrodes X1 to X8 are shown in a plane that is deeper than the plane in which the row electrodes Y1 to Y4 are located.

The column electrodes X1 to X8 are each connected to a different output SX1 to SX8 of a first addressing device or column control and addressing device 2, and the row electrodes Y1 to Y4 are connected to a second addressing device or row control and addressing device 3.

According to one characteristic of the invention, the row electrodes Y1 to Y4 are formed into groups G1, G2, each connected to a different output SG1, SG2 of the row control and addressing device 3. In principle, at least one group of at least two rows Y1 to Y4 is thus formed but, in practice, it may be thought that it is simpler to form a plurality of groups each comprising one and the same number N at least each equal to two row electrodes. In this spirit, in the non-restrictive example of the invention, where only four row electrodes Y1 to Y4 are shown in order to simplify FIG. 1, these row electrodes are formed into two groups G1, G2. The first group G1 comprises the first and second row electrodes Y1, Y2, and the second group G2 comprises the third and fourth row electrodes Y3, Y4. The two electrodes Y1, Y2 of the first group G1 are connected to one and the same output SG1 of the control and addressing device 3, the second output SG2 of which is connected to the two electrodes Y3, Y4 of the second group G2.

Under these conditions, the row electrodes Y1, Y2 of the first group correspond to one and the same address and can therefore be addressed simultaneously, and the row electrodes Y3, Y4 of the second group G2 are at a second same address and can therefore be addressed simultaneously. This means that, in a certain way, the first and second row electrodes Y1, Y2 of the first group G1 form a single row electrode G1 having at least two arms Y1 and Y2, and the second group G2 forms a second single row electrode having two arms Y3 and Y4.

It is seen that each of the column electrodes X1 to X8 forms an crossing with each of the two groups G1, G2 in as many points as there are arms or row electrodes Y1 to Y4 belonging to this group. Thus, for example, if we consider the first column electrode X1, this electrode crosses the first group G1 at the first row electrode Y1 and at the second row electrode Y2. The first column electrode X1 then crosses the second group G2 at the third row electrode Y3 and then at the fourth row electrode Y4. The same is the case for the other column electrodes X2 to X8.

In a configuration such as this, it is clear that a pixel cannot be formed at each crossing between a column electrode X1 to X8 and a row electrode Y1 to Y4 (as in the prior art) because it is not possible, with a standard method for the control and addressing of the pixels, such as the one described, for example, in the documents cited above, to generate a selective discharge at the crossing between a given column electrode and a given row electrode without avoiding, also a discharge between this same column electrode and another row electrode belonging to the same group. Thus, for example, it is not possible to form a pixel at the intersection or crossing between the first column electrode X1 and the second row electrode Y2, these two row electrodes Y1, Y2 belonging to the same first group G1.

Thus, with a view to setting up only one pixel at the crossing of a given column electrode X1 to X8 and a given row electrode Y1 to Y4, without setting up pixels at the other crossings between this same column electrode and one or more row electrodes Y1 to Y4 belonging to the same group as the given electrode, according to a particularly important characteristic of the invention, the crossing or intersection designed to define a pixel is given a crossing surface Sc (shown in the figure by hatched lines) which is greater than the crossing surface or intersection surface St (shown by hatched lines) of a simple crossing Cs, namely a crossing not designed to define a pixel. The crossing surfaces and the intersection surfaces Sc, St are defined by a surface facing the row electrodes Y1 to Y4 and the column electrodes X1 to X8 which form these crossings.

In the non-restrictive example shown in FIG. 1, we find, according to this concept:

along the first row electrode Y1 of the first group G1: a first pixel PX1 formed by a crossing surface Sc at the intersection with the first column electrode X1; then there is a simple crossing Cs having a reduced intersection surface St, formed at the intersection with the second column electrode X2; then there is a second pixel PX2 formed by a crossing surface Sc at the intersection with the third column electrode X3; then a second simple crossing formed at the intersection with the fourth column electrode, and so on until a fourth simple crossing Cs formed at the intersection St with the eight column electrode X8;

along the second row electrode Y2: there is a single crossing Cs formed at the intersection with the first column electrode X1; then a fifth pixel PX5 formed by a crossing surface Sc at the intersection with the second column electrode X2; then a simple crossing Cs formed at the intersection with the third column electrode X3; then a sixth pixel PX6 formed by a crossing surface Sc at the intersection with the fourth column electrode X4; and so on until the eighth pixel PX8 formed by a crossing surface Sc at the intersection with the eight column electrode X8.

According to a similar arrangement, the row electrodes Y3, Y4 of the second group G2 determine, at their crossing with the column electrodes X1 to X8, pixels PX9 to PX12 for the third row electrode Y3 and pixels PX13 to PX16 for the fourth row electrode Y4.

The crossing surfaces Sc (at the pixels PX1 to PX16) may be made to be greater than the intersection surfaces St that the simple crossings Cs have, for example by widening either the column electrodes X1 to X8 as shown in FIG. 1, or by widening the row electrode Y1 to Y4 or even by widening these two electrodes. In taking, for example, the crossing surface Sc which defines the first pixel PX1 (this example being valid also for the other crossing surfaces the first column electrode X1 has a width, at this level, which is greater than the width 12 that it has at a simple crossing Cs where this column electrode forms only a conductor. It has been observed, for example, that in giving the width 11 of a crossing surface Sc (forming a pixel) 0.1 mm more than the second width 12 (simple crossing) the increase in area resulting therefrom enables a reduction of about 10 volts in the voltage needed to provide for the triggering (erasure or writing) or sustaining discharges. Consequently, the differences in potential developed between column electrodes X1 to X8 and row electrodes Y1 to Y4, during the semi-selective, selective and sustaining phases, which are standard per se, may be adjusted so that, given the increase in the crossing surface Sc at the pixels PX1 to PX16, these potential differences are enough to generate electrical discharges at the pixels, and are not enough to generate discharges at the simple crossings Cs. These differences in potential are generated, for example in a manner known per se, by voltage pulses (not shown) which are applied to these electrodes (X1 to X8 and Y1 to Y4) by line and column addressing devices 3, 2, these devices having a common reference potential, for example ground. The amplitude of these pulses determines the voltage values VY applied to the row electrodes Y1 to Y4 and the values of the voltages VX applied to the column electrodes X1 to X8.

In this configuration, it becomes possible to achieve a selective addressing operation simultaneously for the pixels belonging to rows of pixels L1 to L4 of one and the same group. The pixels PX1 to PX4 formed with the first row electrode Y1 form a first row of pixels L1, belonging to the first group G1, just like the pixels PX5 to PX8, which are formed with the second row electrode Y2 and form a second row of pixels L2. The pixels PX9 to PX12, which are formed by means of the third row electrode Y3, form a third row of pixels L3 which belong to the second group G2, just like the pixels PX13 to PX16 which are formed by the fourth row electrode Y3 and constitute a fourth row of pixels L4.

Thus, for example, in addressing, firstly, the first group G1, i.e. simultaneously the first and second row electrodes Y1 and Y2, and in addressing, secondly, the first, second, sixth and eighth column electrodes, X1, X2, X6 and X8, simultaneously, it is possible to achieve, selectively, either the erasure or the writing of, simultaneously, the first pixel PX1 which belongs to the first row L1, and of the fifth, seventh and eighth pixels PX5, PX7 and PX8 which belong to the second row of pixels L2.

It must be noted that, in the non-restrictive example described, each group G1, G2 has only two row electrodes Y1, Y2 and Y3, Y4 but, of course, each group G1, G2 could be formed by a greater number n of row electrodes Y1 to Y4. Thus, the number of row addresses (which corresponds to the number of groups G1, G2) would be smaller than the total number of row electrodes Y1 to Y4, thus achieving an increase in the number of row electrodes that can be addressed and, consequently, the number of rows L1 to L4 of pixels, for which the pixels PX1 to PX16 may be controlled selectively and simultaneously. However, this increase in the number of rows L1 to L4 that can be increased simultaneously requires an increase in the number of column electrodes X1 to X8. For example, in the prior art, to obtain 16 pixels, it is enough to have 4 row electrodes and 4 column electrodes. By contrast, with the present invention, if 4 row electrodes are divided into two groups G1, G2, each having a number n of two row electrodes connected to one and the same output of the row control and addressing device 3, the number of row addresses is divided by the ratio of the total number of row electrodes to the number of groups (that is, by 2 in the example), and the number of column electrodes has to be increased by the same ratio. This means that if each group G1, G2 had four row electrodes, it would be necessary to use 16 column electrodes to form 16 pixels. In other words, in assuming that all the groups G1, G2 have one and the same number n of row electrodes, all the rows L1 to L4 may have one and the same number N of pixels PX1 to PX16 and, in this case, the number M of column electrodes X1 to X4 should be equal to the product of the number N of pixels per row L1 to L4 by the number n of row electrodes Y1 to Y4 of each group G1, G2, giving $M=N\times n$ (in the example, $M=4\times 2$).

In the non-restrictive example shown in FIG. 1, the column electrodes X1 to X8 are rectilinear and, for a given column electrode, it is necessary that, at one level or another, a pixel should be separated from a following pixel by a simple crossing Cs. Thus, for example, in the non-restrictive example described, the first pixel PX1 is separated from the next pixel PX9 by a simple crossing Cs formed with the second row electrode Y2, which forms a neighbouring pixel PX5 with a neighbouring column electrode X2, so that, in this arrangement, the pixels PX1 to PX16 appear to be placed substantially in a quincunxial arrangement. For, a first column of pixels C13 is formed by the first and ninth pixels, a second column of pixels C2 is formed by the fifth and thirteenth pixels PX5, PX13, a third column C3 is formed by the second and tenth pixels PX2, PX10, and so on, until an eighth column of pixels C8 which comprises the eighth and sixteenth pixels PX8, PX16. These rows of pixels are symbolized in the figure by lines of dots and dashes. These pixels are offset from one row electrode to a following row electrode by a distance corresponding to the pitch P according to which the column electrodes X1 to X8 are arranged. However, it is possible to give the column electrodes X1 to X8 a geometry such that all the intersections between a column of pixels and a row electrode Y1 to Y4 are formed by a pixel.

It should be noted that this arrangement, in groups G1, G2, of the row electrodes Y1 to Y4, enables the connecting together, on the side on which their two ends 5, 6 are located for example, of the row electrodes Y1 to Y4 of one and the same group G1, G2, by means of connecting conductors 12.

The result thereof is a particularly major advantage that resides in the fact that a break 10 in a rox electrode, the second row electrode Y2 for example, is self-repaired. For, in this case, the electrical supply of the pixels PX6, PX7, PX8, located on the section Y2', placed opposite the first end 5 with respect to the break 10, is ensured by the first row electrode Y1 and by connecting conductors 12 which connect these two row electrodes Y1, Y2.

Figure 2:
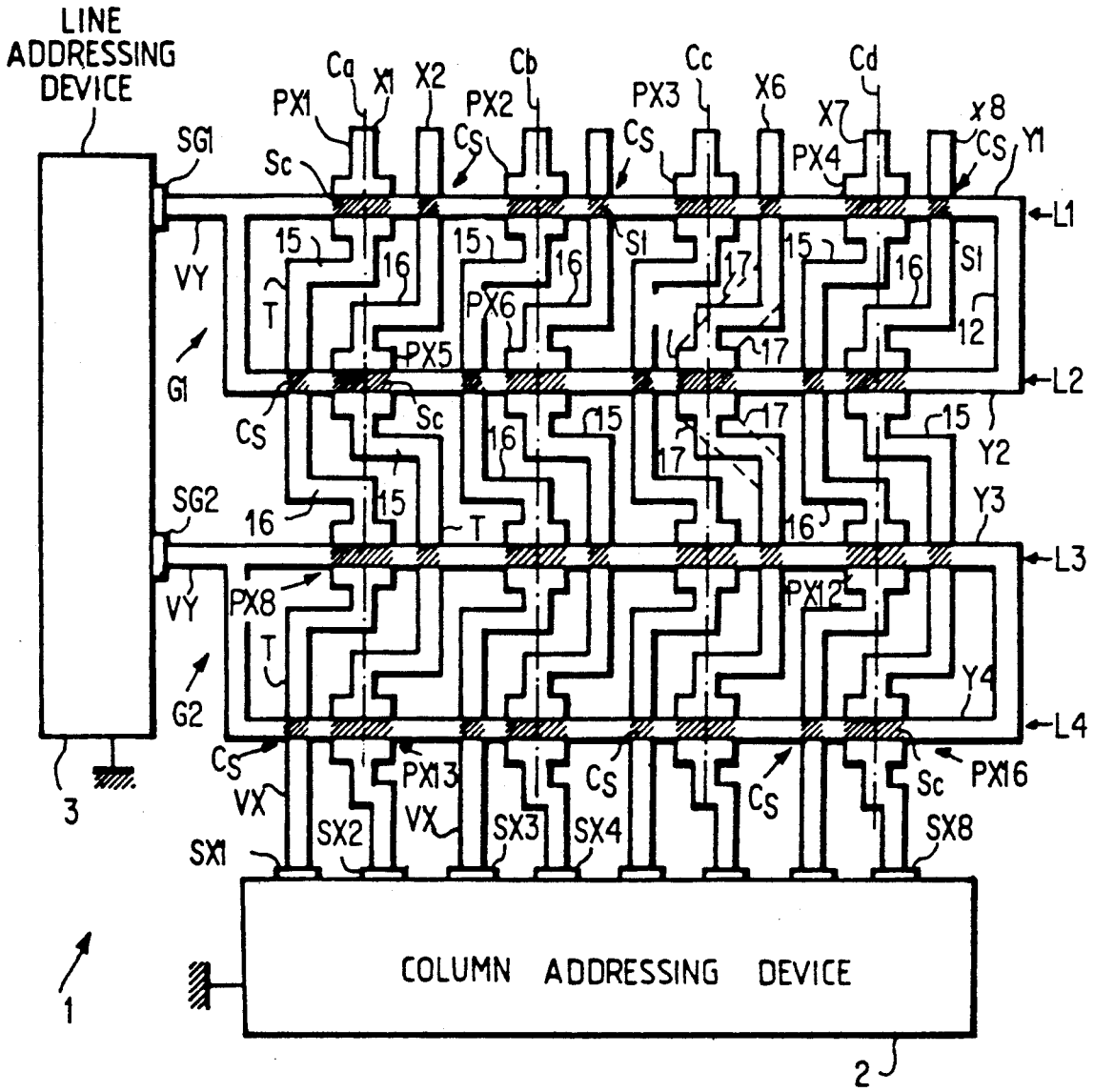
FIG. 2 gives a schematic view, as a non-restrictive example, of a plasma panel in a second version of the invention, wherein the column electrodes are provided with deflectors forming changes in direction and enabling a second form of distribution of the pixels to be obtained.

FIG. 2 shows a matrix 1 according to the invention, wherein each crossing between a column of pixels and a row electrode Y1 to Y4 forms a pixel, so that the pixels PX1 to PX16 are no longer distributed quincunxially as in the example of FIG. 1.

In the non-restrictive example described, the plasma panel 1 has row electrodes Y1, Y2, Y3, Y4 arranged in a same way as in the example of FIG. 1, and also has eight column electrodes X1 to X8, enabling the making of 16 pixels PX1 to PX16.

Unlike in the example of FIG. 1, the column electrodes X1 to X8 are not rectilinear by have a plurality of deflectors 15 or turnings so as to enable the alignment, on one and the same column of pixels Ca, Cb, Cc, Cde, of the pixels PX1 to PX16, formed by neighbouring electrodes X1 to X8 (in the non-restrictive example described, two neighbouring column electrodes). In the non-restrictive example of the description, the deflectors of the column electrodes X1 to X8, which serve to define one and the same column of pixels, have a complementary shape but, of course, these deflectors may have a different shape from the one shown in FIG. 2, and they may also have different shapes from one another.

In the example, the first column electrode X1 crosses the first row electrode Y1, so as to form the first pixel P1 which is substantially centered on the line representing the first column of pixels Ca. The first column electrode X1 then becomes parallel to the row electrodes so as to form a first deflector 15, and releases the intersection with the second row electrode Y2 and the first column of pixels so as to form a first deviation deflector 15 and release the intersection with the second row electrode Y2 and the first column of pixels Ca, an intersection at which there is located the fifth pixel PX5, formed by the passage of the second column electrode X2. This second column electrode X2 has a return deflector 16 enabling it to be placed on the column Ca. The intersection between a straight section T of the first column electrode X1 and the second row electrode Y2 forms a simple crossing Cs located outside the column Ca and, after this simple crossing, the first column electrode X1 has a return deflector 16 which brings it back to the column Ca of pixels so that, at its intersection with the third row electrode Y3, it forms the ninth pixel PX9. Of course, the second column X2 has a deviation deflector 15 enabling it to move away from the column Ca of pixels to make place for the first column electrode X1. As shown in FIG. 2, a similar arrangement is obtained for the crossing of the other row electrodes, and similarly for the other column electrodes X3 to X8. As a result, the pixels PX1 to PX16 are aligned on four columns of pixels Ca, Cb, Cc, Cd, each having four pixels, while the rows of pixels L1 to L4 also have four pixels as in the example of FIG. 1.

It must be noted that, in the non-restrictive example described, the turnings or deflectors 15, 16, are formed by changes in direction of the column electrodes X1 to X8. These changes occur in directions perpendicular and/or parallel to the row electrodes Y1 to Y4 and to the columns Ca to Cd of pixels, but these turnings can also be made in oblique directions as illustrated, for example, by dotted lines 17 at the seventh pixel PX7, formed between the sixth column electrode X6 and the second row electrode Y2.

Figure 3:
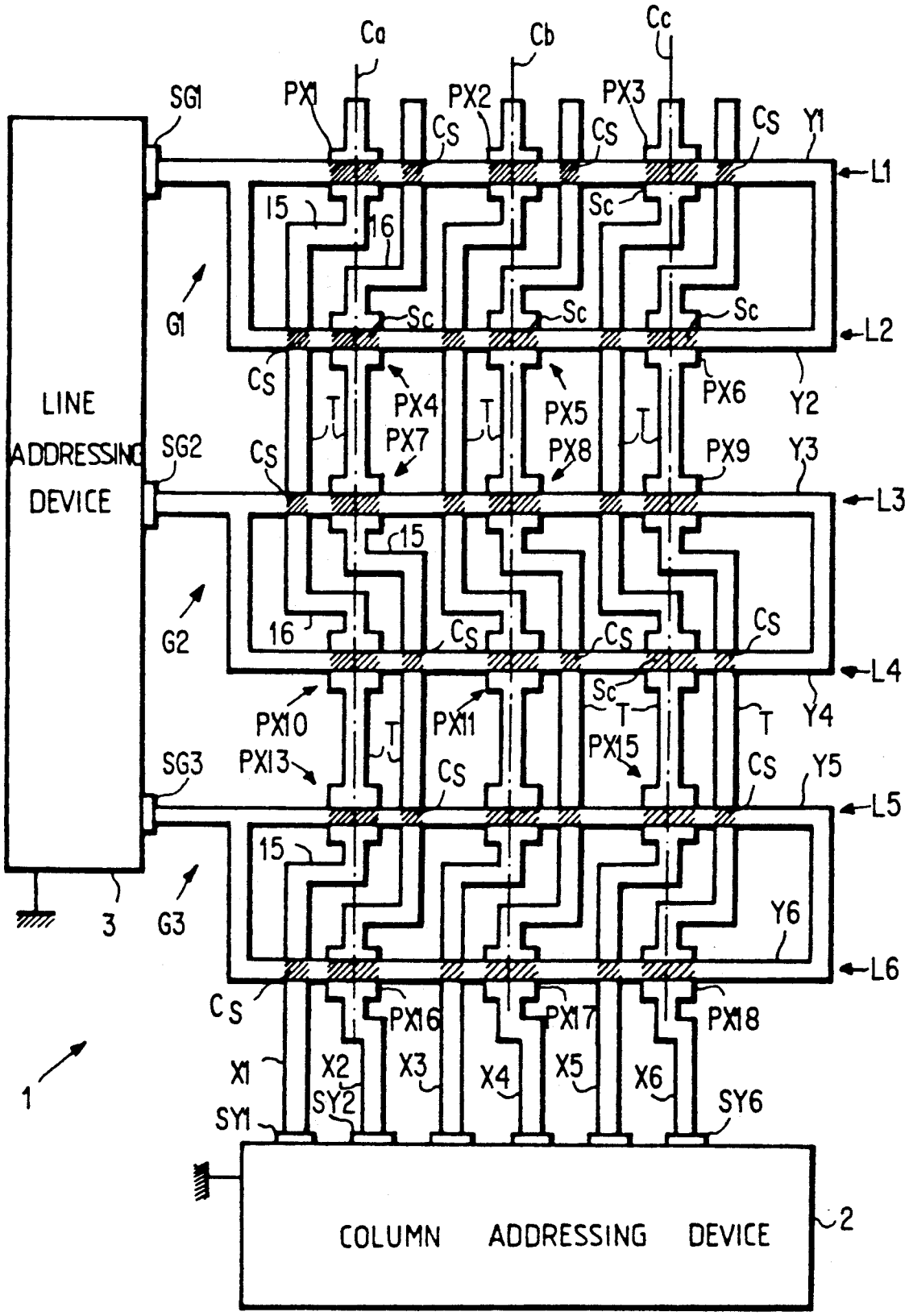
FIG. 3 gives a schematic view, as a non-restrictive example, of a plasma panel according to a preferred embodiment of the invention, wherein the column electrodes have a smaller number of deflectors for one and the same distribution of pixels as in FIG. 2.

FIG. 3 shows a plasma panel according to the invention, and illustrates the way to simplify the column electrodes, so as to reduce the number of deflectors 15, 16 or turnings for one and the same arrangement of pixels as in the example of FIG. 2. In the non-restrictive example described, FIG. 3 shows three groups G1, G2, G3 connected to an output SG1, SG2, SG3 of the row control and addressing device 3. Each group has two row electrodes, Y1 and Y2, Y3 and Y4, Y5 and Y6 respectively, according to an arrangement similar to the one described above. Six column electrodes X1 to X6 are shown. These electrodes X1 to X6 are arranged along one and the same column of pixels. Thus, for each row electrode Y1 to Y6, three simple crossings Cs and three pixels are formed giving, in all, 18 pixels PX1 to PX18 in the example, at a rate of three pixels per row L1 to L6 and six pixels per column Ca, Cb, Cc.

Starting with a first electrode X1, the latter is aligned with the row representing the first column Ca of pixels. It intersects the first row electrode Y1 so as to form the first pixel PX1 and then moves away from the first column Ca with a deviation deflector 15, and then becomes perpendicular to the row electrodes to cross the second and third row electrodes Y2, Y3, in simple crossings Cs. Then, a return deflector 16 brings it back to the axis of the first column Ca so that it successively crosses the fourth and fifth row electrodes Y4 and Y5, in forming the pixels PX10 and PX13. A deviation deflector 15 again moves the first column Ca away, and it resumes a direction perpendicular to the sixth row electrode Y6 which it crosses in a simple crossing Cs located outside the first column Ca. The second column electrode X2, at the outset, is parallel to the first column electrode X1 and crosses the first row electrode Y1 in a simple crossing Cs. After this crossing, it has a return deflector 16 which places it on the axis of the first column Ca to that it crosses successively, and along one and the same straight line, the second and third row electrodes Y2, Y3 with which it forms the fourth and seventh pixels PX4, PX7. It is then offset from the axis of the first column Ca by a deviation deflector 15, and crosses the fourth and fifth row electrodes Y4 and Y5 by simple crossings Cs, before being brought back to the axis of the first column Ca by a return deflector 16. It is then perpendicular to the sixth row electrode Y6 which it crosses in forming the sixteenth pixel PX16. A same shape is given to the third and fourth column electrodes X3, X4 which together enable the formation of a second column Cb of pixels formed by the pixels PX2, PX5, PX8, PX11, PX14 and PX17. The fifth and sixth column electrodes X5, X6 similarly form pixels PX3, PX6, PX9, PX12, PX15, PX18, aligned along one and the same column Cc.

In this arrangement, it is seen that each column electrode X1 to X6 has straight line sections T between row electrodes Y1 to Y6 that are adjacent but belong to different groups G1, G2, G3. This is the case both between simple crossings Cs and between enlarged surface crossings Sc forming pixels. The result thereof is a decrease in the number of deflectors and a simplication of the fabrication process.

Figure 4:
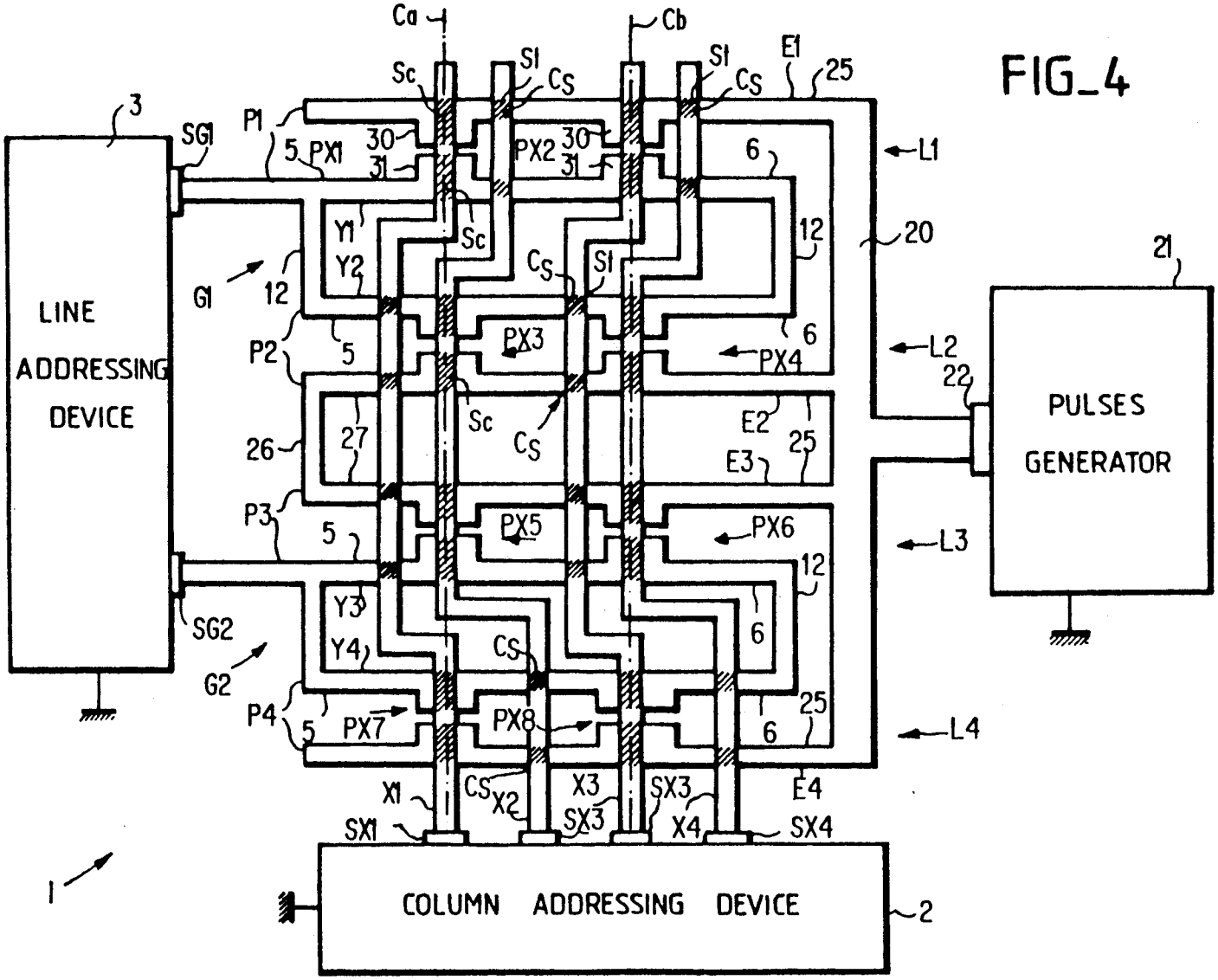
FIG. 4 shows a non-restrictive, exemplary, schematic view of a coplanar sustaining type of plasma panel having an arrangement of electrodes according to the invention.

FIG. 4 shows that the invention can also be applied to the case of a plasma panel 1 of the coplanar sustaining type. In the non-restrictive example of the invention, the panel 1 has eight pixels arranged in two columns: a first column of pixels Ca has four pixels PX1, PX3, PX5, PX7 and the second column Cb has the four pixels PX2, PX4, PX4, PX8.

The pixels PX1 to PX8 are defined at the crossing between solely addressing electrodes which, in the non-restrictive example described, form four column electrodes, X1, X2, X3 and X4, with four pairs of sustaining electrodes P1, P2, P3, P4 which are perpendicular to the solely addressing electrodes. The pairs P1 to P4 are consequently arranged in rows. In a manner that is standard per se, each pair P1 to P4 is formed by a so-called solely sustaining electrode E1 to E4, having the sole function of enabling the sustaining discharges and being taken, at the same instants, to same potentials. The result thereof is that these solely sustaining electrodes do not have to be addressed and, therefore, do not have to be individualized and may, if required, be all connected to one another on their first end 25 side by a connecting conductor 20, and may be connected to one and the same output 22 of a pulse generator 21.

Each pair P1 to P4 further has a so-called addressing-sustaining electrode Y'1 to Y'4 which has, firstly, the function of ensuring, with the solely sustaining electrodes E1 to E4, the sustaining discharges of the pixels PX1 to PX8 and, secondly, an addressing function. The column electrodes X1 to X4 fulfil a solely addressing function.

Thus, the addressing-sustaining electrodes have to be individualized, as was the case for the electrodes Y1 to Y4 in the previous examples. In accordance with the concept of the invention, the addressing-sustaining electrodes are assembled by groups G1, G2. Each group has at least two addressing-sustaining electrodes connected together and to the row control and addressing device 3 in one and the same way in the preceding examples for the row electrodes Y1 to Y4. In the example shown in FIG. 4, the first and second addressing-sustaining electrodes Y' , Y2 are connected to each other on their first end 5 side, and connected to the output SG1 of the control and addressing device 3, and they are also connected to each other on their second end 6 side by a connection 12. In the non-restrictive example described, with respect to the plane of the figure, the electrodes of the pairs P1 to P4 are represented in a plane which is deeper than that of the column electrodes X1 to X4.

In this configuration, starting from the top of the figure, a first solely sustaining electrode E1 forms a pair Pl with a first addressing-sustaining electrode Y'1. Then there is a second addressing-sustaining electrode Y'2 forming a second pair P2 with a second solely sustaining electrode E2; then there is a third solely sustaining electrode E3 which is seen to be connected by a connection 26 to the second solely sustaining electrode E2, on a second end 27 side of these electrodes. The third solely sustaining electrode E3 forms a third pair P3 with a third addressing-sustaining electrode Y'3. This third addressing-sustaining electrode Y'3 is followed by a fourth addressing-sustaining electrode Y'4 which forms a fourth pair P4 of sustaining electrodes with a fourth solely sustaining electrode E4.

As in the preceding examples, pertaining to the row electrodes Y1 to Y4, the addressing-sustaining electrodes Y'1 to Y'4 belonging to one and the same group G1, G2 are connected together on their ends 5, 6 side. This means that the above-mentioned advantage concerning the self-repairing of the breaks can also be found in this application of the invention. This advantage also exists for the solely sustaining electrodes E1 to E4 which can also be connected to their ends 25, 27 because these sustaining electrodes Y'1 to Y'4 and E1 to E4 are arranged in a sequence of two purely sustaining electrodes E1 to E4 followed by two addressing-sustaining electrodes Y1 to Y4. It must be noted that this arrangement further enables a reduction in the lateral capacitances (not shown) formed between successive electrode pairs P1 to P4.

The first column electrode X1 crosses the first pair P1 above the projecting parts 30, 31 with which the solely sustaining electrodes E1 to E4 and the addressing-sustaining electrodes Y'1 to Y'4 are respectively provided. These projecting parts 30, 31 form localized growths of the surface of these electrodes, and in the same pair P1 to P4, the projecting parts 30, 31 face each other and are oriented to each other. These projecting parts 30, 31 are placed at the pixels PX1 to PX8, and one of the valuable aspects of these projecting parts is to localize the sustaining discharges. Another valuable aspect, in the framework of the present invention, is that at least one of the projecting parts 30, 31, notably the one belonging to addressing-sustaining electrodes Y'1 to Y'4, can be used to obtain a crossing surface Sc, at the level of each pixel, which is greater than the intersection surface St formed at the simple crossing Cs of a column electrode X1 to X4 with one of the sustaining electrodes, i.e. outside one of these projecting parts. This latter crossing then forms a simple crossing Cs, if the above-mentioned potential differences are small enough for the electrical discharges to be generated between a pair P1 to P4 and a column electrode X1 to X4 solely at the pixels PX1 to PX8.

As already explained, the enlarged crossing surfaces Sc, i.e. the surfaces enabling a pixel to be formed, can also be obtained by bringing the shape of the row electrodes into play. This is the case, besides, in the example described with reference to FIG. 4 where it must be assumed that the sustaining electrodes Y'1 to Y'4 and E1 to E4 are electrodes arranged in a row. However, particularly in the case of plasma panels for which the sustaining discharges are not set up between the coplanar sustaining electrodes, the row electrodes Y1 to Y4 may have a geometry of the type shown, for example, in the FIGS. 5 with a view to forming enlarged intersection surfaces.

Figure 5:
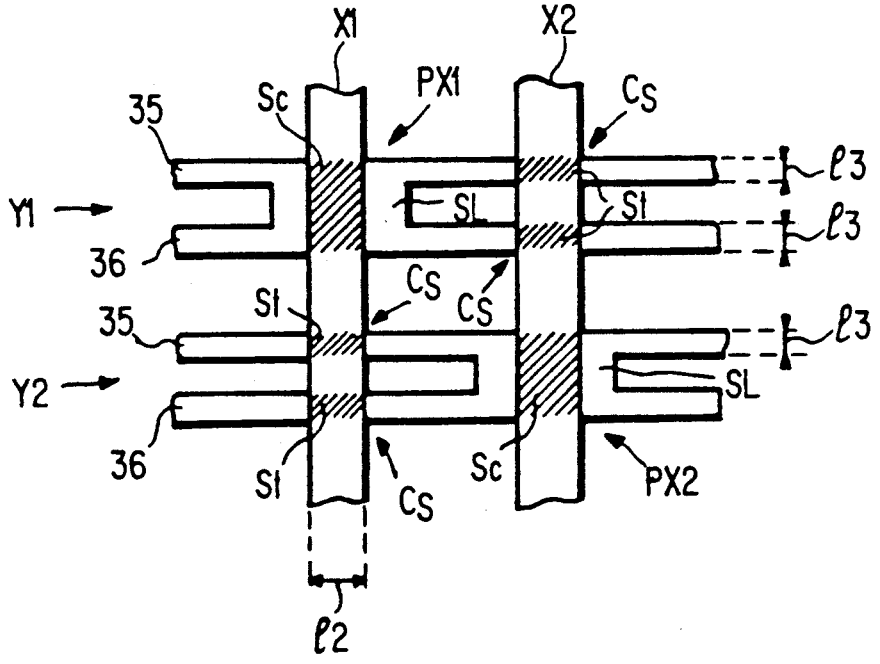
FIG. 5 shows a schematic view of a different embodiment of the electrodes shown in FIGS. 1 to 4.

FIG. 5 shows row electrodes Y1, Y2 shown in a deeper plane than column electrodes X2, X3 with respect to the plane of the figure. The example is limited to the depiction of two row electrodes and two column electrodes, Y1, Y2 and X1, X2, to simplify FIG. 5. The embodiment shown in FIG. 5 enables crossing surfaces Sc of a widened area to be obtained, namely surfaces suitable for the formation of the pixels through a modification of the geometry of the electrodes of the rows Y1, Y2 at the places designed to form these pixels. In the non-restrictive example described, this embodiment can be applied particularly to a distribution of pixels such as the one shown in FIG. 1 and, for example, especially in the case of crossings formed between the row electrodes Y1 and Y2 and the two column electrodes X1 and X2. But, of course, the geometry given to the row electrodes Y1, Y2 could be used with another distribution of pixels, as is shown, for example, in the FIGS. 2 and 3, and it must be further noted that the column electrodes could also have a similar geometry.

The row electrodes Y1, Y2 are each formed by a first conductor and a second conductor 35, 36, which are parallel, each having, for example, a width 13 which was also the width of the row electrodes in the previous examples. The column electrodes X1, X2 have the second width X1, X2 with the second width 12 (the smallest width).

At the crossing between column electrodes X1, X2 and row electrodes Y1, Y2, which are designed to form pixels, the two conductors 35, 36 of one and the same row electrode Y1, Y2 are connected by a connecting surface SI which may be likened to an increase in the width 13 of either of the two conductors 35, 36. The result thereof is that the crossings have a crossing surface Sc which is greater, at the crossings designed to form pixels, than at the other crossings. Thus, for example, starting from the top of the figure, the first column electrode X1 crosses the first row electrode Yl at a connecting surface SI so that the crossing surface Sc is enough to form a pixel PX1, i.e. the voltage applied between the column electrode X1 and the row electrode Y1 enable the generation of discharges at this level. Then, the first column electrode X1 crosses the second row electrode Y2 successively at the level of the first and second conductor 35, 36 with which it successively forms intersection surfaces St that do not permit the obtaining of discharges with voltage conditions as low as those enabling discharges at the pixel PX1. For the second column electrode X2, its crossing with the first row electrode determines two intersection surfaces St with smaller areas, and then its crossing with the second row electrode Y2 at a level where this electrode Y2 has a connecting surface S1 defines a crossing surface Sc which is sufficient to form a pixel PX5.

This description forms a non-restrictive example which shows, firstly, that it is possible to form a number of crossings between row electrodes and column electrodes which is greater than the number of desired pixels, in making crossing surfaces Sc that are greater at the level of the pixels than for the other crossings Cs, and in adjusting the voltages VX and the voltages VY respectively applied to the column electrodes and the row electrodes, so that the potential differences VX-VY generated by these voltages between these column electrodes and row electrodes are enough to obtain electrical discharges at the level of the pixels and not enough to produce electrical discharges at the level of the simple crossings. Of course, other embodiments are possible without going beyond the scope of the invention, as regards, for example, the form of the electrodes and their arrangement in rows and columns, or again the position of the column electrodes on the visible part side of the panel, or conversely. This description shows, moreover, how to arrange the different row and column electrodes in order to obtain, in combination with the making of the above-mentioned pixels and an increase in the number of column electrodes, row electrodes assembled in groups. The row electrodes of one and the same group are connected to one and the same output of the row addressing and control register 3, so that, for one and the same number of pixels (each row L1 to L4 of pixels corresponding to a row electrode Y1 to Y4), the number of addresses is diminished. And it is possible to simultaneously control the pixels formed by means of the row electrodes located at one and the same address, namely belonging to one and the same group G1, G2, the selection of the pixels belonging to one and the same group being obtained by the addressing or choice of the column electrodes, the number of which is increased.

It must be noted that the invention can be applied to all AC type plasma panels, whatever may be the precise technology by which they are made and whatever may be their control mode. The invention can also be applied to DC plasma panels, for which the implementation of the invention offers additional advantages owing to the fact that, in these DC type panels, the number of rows to be controlled restricts not only the duration of the total addressing cycle time but also the quantity of light that a pixel may emit. Thus, in the case of the DC type panel, the application of the invention enables improvements in both these parameters at the same time.

What is claimed is:

1. A plasma panel comprising pixels arranged in rows of pixels and columns of pixels, column electrodes crossing or intersecting row electrodes and defining a plurality of crossings or intersections, a column control and addressing device to which the column electrodes are connected, a row control and addressing device to which the row electrodes are connected, each crossing having a crossing surface formed by the facing surfaces of the corresponding column electrode and row electrode, wherein the crossing comprise, firstly, simple crossings and comprise, secondly, widened crossings having a greater crossing surface than the crossing surface of the simple crossings, wherein each pixel is defined substantially at a widened crossing, wherein the number M of column electrodes is greater than the number N of pixels contained in a row of pixels, and wherein the number M of column electrodes corresponds to the product of the number n of row electrodes which form one group, by the number N of pixels contained in a row of pixels, giving $M=n\times N$.

2. A plasma panel according to claim 1, of the coplanar sustaining AC type.

3. A plasma panel comprising pixels arranged in rows of pixels and columns of pixels, column electrodes crossing or intersecting row electrodes and defining a plurality of crossings or intersections, a column control and addressing device to which the column electrodes are connected, a row control and addressing device to which the row electrodes are connected, each crossing having a crossing surface formed by the facing surfaces of the corresponding column electrode and row electrode, wherein the crossings comprise, firstly, simple crossings and comprise, secondly, widened crossings having a greater crossing surface than the crossing surface of the simple crossings, and wherein each pixel is defined substantially at a widened crossing, said panel of the coplanar sustaining AC type, pairs of sustaining electrodes intersecting with solely addressing electrodes, each pair of electrodes being formed by an addressing-sustaining electrode and a solely sustaining electrode, the addressing-sustaining electrodes and the solely sustaining electrodes having projecting surfaces which, between the two electrodes of the same pair, are oriented towards each other and enable the definition, at the intersection with a purely addressing electrode, of a widened surface where a pixel is formed.

4. A plasma panel according to claim 3, wherein at least two row electrodes are connected to one and the same output of the row control and addressing device, so as to enable simultaneous addressing of these two row electrodes.

5. A plasma panel according to claim 3, wherein the row conductors are formed into a plurality of groups, each having at least two row electrodes connected to one another, each group being connected to a different output of the row control and addressing device.

6. A plasma panel according to claim 5, wherein all the groups have one and the same number n of row electrodes.

7. A plasma panel according to one of the above claims, wherein the column electrodes and/or row electrodes have a width which is greater at the pixels than the width that they have at the simple crossings.

8. A plasma panel according to claim 3, wherein the number M of column electrodes is greater than the number N of pixels contained in a row of pixels.

9. A plasma panel according to claim 3, wherein the column electrodes are substantially rectilinear.

10. A plasma panel according to claim 3, wherein the column electrodes and/or row electrodes have turnings.

11. A plasma panel according to claim 10, wherein a column of pixels is formed by at least two column electrodes.

12. A plasma panel according to claim 10, wherein the turnings are formed by successive changes in direction that are substantially perpendicular from one direction to another.

13. A plasma panel according to claim 3, wherein the column electrodes and/or row electrodes are formed by at least two parallel conductors connected to each other by a connecting surface at the level of the widened crossings where pixels are formed.

14. A plasma panel according to claim 4, wherein at least two row electrodes of one and the same group are connected to each other at each of their ends.

15. A plasma panel according to claim 3, wherein the row and column addressing and control devices deliver voltages that are sufficient to generate electrical discharges at the pixels and insufficient to generate discharges at the simple crossings.

16. A plasma panel according to claim 3, having a first addressing device and a second addressing device, to which there are respectively connected the solely addressing electrodes and the addressing-sustaining electrodes, wherein the address-sustaining electrodes are formed into a plurality of groups, each having at least two addressing-sustaining electrodes, connected to each other, each group being connected to a different output of the second addressing device.

17. A plasma panel according to claim 16, wherein the arrangement of the solely sustaining and addressing-sustaining electrodes comprises at least one sequence of two solely sustaining electrodes followed by two addressing-sustaining electrodes Lf one and the same group.

18. A plasma panel according to claim 17, wherein two successive, addressing-sustaining electrodes of one and the same group are connected to each other at their two ends.

19. A plasma panel according to claim 17, wherein two successive, solely sustaining electrodes are connected to each other at their two ends.

20. A plasma panel according to claim 16 wherein, in addition to the widened crossings forming pixels, the crossings between solely addressing electrodes and the pairs of electrodes form simple crossings with a smaller crossing surface than the crossing surface of the pixels, and wherein the addressing devices deliver voltages that are sufficient to generate electrical discharges at the level of the pixels and insufficient to generate these discharges at the level of the simple crossings.

21. A plasma panel according to claim 3, wherein the solely addressing electrodes form column electrodes and wherein the pairs are arranged in rows.

* * * * *